United States Patent [19]

Morales

[11] 4,079,941

[45] Mar. 21, 1978

[54] BOARD GAME

[76] Inventor: Joseph Morales, c/o Garcia - Apt. 10, 644 Wales Ave., Bronx, N.Y. 10455

[21] Appl. No.: 665,375

[22] Filed: Mar. 10, 1976

[51] Int. Cl.[2] ..... A63F 3/02

[52] U.S. Cl. ..... 273/260; 273/282; 273/283; 273/284; 273/290

[58] Field of Search ..... 273/131, 136

[56] References Cited

U.S. PATENT DOCUMENTS

| | | | |
|---|---|---|---|
| 2,722,425 | 11/1955 | Gazelle | 273/136 G X |
| 3,799,549 | 3/1974 | Laker | 273/131 AB |

FOREIGN PATENT DOCUMENTS

| | | | |
|---|---|---|---|
| 552,979 | 12/1956 | Belgium | 273/131 K |

*Primary Examiner*—William H. Grieb
*Assistant Examiner*—Harry G. Strappello
*Attorney, Agent, or Firm*—Kirschstein, Kirschstein, Ottinger, Frank & Cobrin

[57] ABSTRACT

A board game called "Airborne" includes a game board having an upper surface, wherein a square pattern of 64 boxes is contained on the upper surface. The lattice-work of upraised strips on the said game board form the perimeter of each box or guide-line square, wherein the individual forms can be placed. The said individual forms, once placed, so as to cover the upper surface of the game board, form the total playing surface of different-sized square and rectangle forms. Innumerable different playing surfaces or patterns can be created as a result of the individual forms being juxtaposed and then some or all of the aforesaid forms can be removed and replaced by different forms and/or some or all of the forms can be removed and replaced by the same forms in different juxtaposition. Two sets of eight movable playing units are contained on and move on the playing surface of square and rectangle forms, wherein the movable units engage and capture each other. All eight units on one end of the game board are white in color and all eight units on the opposite end of the game board are black in color; all sixteen movable units are known as ground units. A ground unit that succeeds in crossing from one end of the game board to the opposite end becomes an airborne unit and, as a result, increases its movement potential.

4 Claims, 44 Drawing Figures

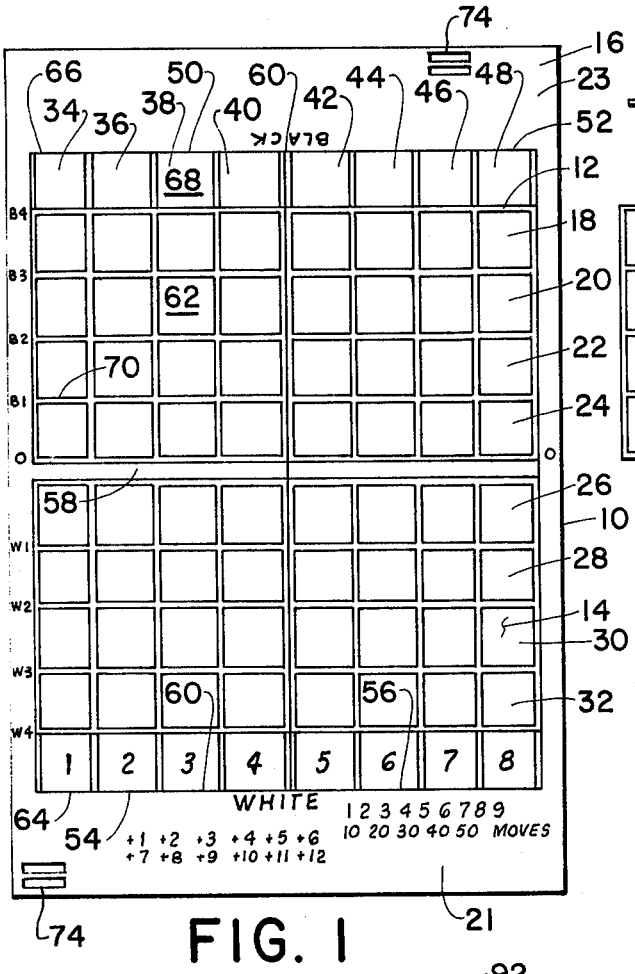
FIG. 1
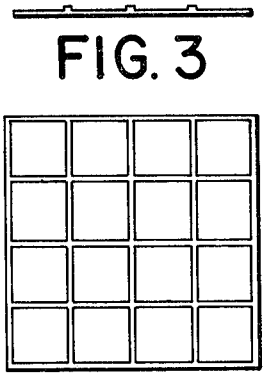
FIG. 2
FIG. 3
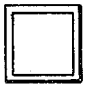
FIG. 4
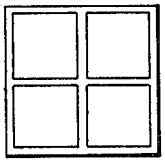
FIG. 5
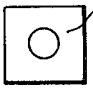
FIG. 6
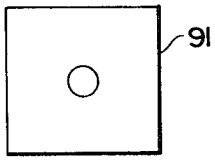
FIG. 7
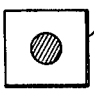
FIG. 8
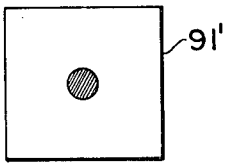
FIG. 9
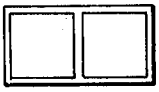
FIG. 10
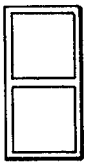
FIG. 11
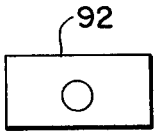
FIG. 12
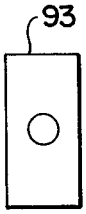
FIG. 13
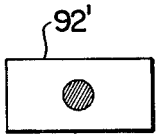
FIG. 14
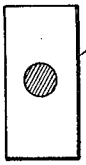
FIG. 15
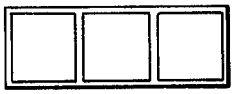
FIG. 16
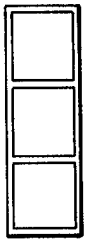
FIG. 17
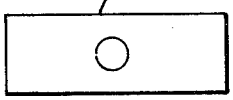
FIG. 18
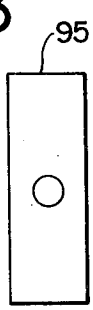
FIG. 19
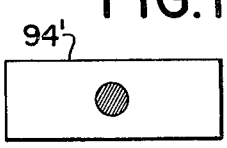
FIG. 20
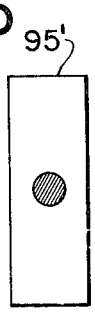
FIG. 21
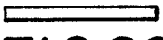
FIG. 22
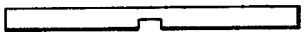
FIG. 23
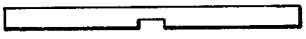
FIG. 24
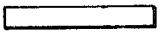
FIG. 25
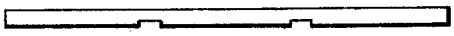
FIG. 26
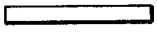
FIG. 27

How a written record of game move appears based upon a regular pattern illustrated in figure 43

| Turns | |
|---|---|
| WHITE 1 | Written W1 |
| BLACK 1 | B1 |

Examples:

W1 means WHITE 1 unit
W1: W1-W4 means WHITE 1 unit moves from WHITE 1 position on game board to WHITE 4 position
W1: 1-W4 means WHITE 1 unit moves from 1 position which is its' starting position to WHITE 4 position on game board C means capture airb means airborne

W1 W3: 3 -W2
B1 B1: 1 -B9

W2 W3: W2 -W6
B2 B1: B9 -B15

W3 W8: 8 -W5
B3 B1: B15-W20

W4 W7: 7 -W4
B4 B3: 3 -B2

W5 W7: W4 -W8
B5 B3: B2 -B6

W6 W4: 4 -W2
B6 B5: 5 -B3

W7 W3: W6 -W10
B7 B5: B3 -B11

W8 W4: W2 -W6
B8 B5: B11-B17

W9 W4: W6 -W17
B9 B5: B17-W18

W10 W1: 1 -W9
B10 B7: 7 -B4

W11 W2: 2 -W1
B11 B7: B4 -B8

W12 W1: W9 -W15
B12 B7: B8 -B12

W13 W2: W1 -W9
B13 B8: 8 -B5

W14 W5: 5 -W3
B14 B6: 6 -B4

W15 W6: 6 -W4
B15 B2: 2 -B1

W16 W6: W4 -W7
B16 B6: B4 -B7

W17 W3: W10 -W16
B17 B3: B6 -B10

W18 W2: W9 -W14
B18 B8: B5 -B13

W19 W8: W5 -W13
B19 B3: B10-B15

W20 W8: W13-W20 C B1
B20 B3: B15-W20 C W8

W21 W5: W3 -W11
B21 B5: W18-W17 C W4

W22 W5: W11-W17 C B5
B22 B4: 4 -B2

W23 W5: W17-B18
B23 B2: B1 -B6

W24 W6: W7 -W11
B24 B2: B6 -B10

W25 W6: W11-W18
B25 B4: B2 -B6

W26 W3: W16-B19
B26 B7: B12-B19 C W3

W27 W5: B18-B19 C B7
B27 B6: B7 B19 C W5

W28 W2: W14-B20
B28 B8: B13-B20 C W2

W29 W1: W15-B20 C B8
B29 B3: W20-W19

W30 W1: B20-B19 C B6
B30 B3: W19-W7

W31 W1: B19-B7
B31 B3: W7 -W4 airb

W32 W6: W18-B17
B32 airb B3: W4 -W8 C W7

W33 W6: B17-B6 C B4
B33 airb B3: W8 -B7 C W1

W34 W6: B6 -B2 airb
B34 B2: B10-B16

W35 airb W6: B2 -W20
B35 airb B3: B7 -W18

W36 airb W6: W20-W4
B36 B2: B16-W19

W37 airb W6: W4 -W20
B37 airb B3: W18-W7

W38 airb W6: W20-W19 C B2
B38 airb B3: W7 -W19 C airb W6

BLACK wins

FIG.44

BOARD GAME

BACKGROUND OF THE INVENTION

A number of board games are commercially available, wherein a plurality of movable playing pieces traverse a fixed playing pattern. However, these games do not provide a means for easily transforming the playing pattern of the playing surface as does my present invention.

SUMMARY OF THE INVENTION

My present invention relates to a unique and novel board game called "Airborne".

An object of my present invention is to provide a board game that is a simple representation of actual aerial views of terrain by placement of squares and rectangles to form innumerable patterns.

A further object of my present invention is to provide a means of readily changing the playing pattern of the playing surface so as to vary the movements of the playing pieces moving on that surface as dictated by the juxtaposition of the squares and rectangles comprising each pattern.

A still further object of my present invention is to provide a board game of battleground situations involving ground units moving forward from position to position, those moves dictated as much by the juxtaposition of the squares and rectangles in each pattern as actual different terrain factors influence movement in real life situations.

Total effect of moves made upon different playing surface playing patterns is a simple representation of tactical moves made on an actual battlefield where different terrain elevations dictate possible movement. Major obstructions, such as water barriers or other natural barriers and man-made barriers are not represented because major obstructions necessitate logistical considerations. Logistics is a part of strategic planning and this game concerns itself with only tactical aspects of movement and capture in the simplest sense.

Briefly, my present invention comprises a game board having an upper surface, wherein a square latticework of 64 boxes is contained on the upper surface. The latticework of upraised strips on the said game board form the perimeter of each box or guide-line square, wherein the individual forms can be placed. The said individual forms, once placed, so as to cover the upper surface of the game board form the total playing surface of different-sized square and rectangular forms. Innumerable different playing surfaces or patterns can be created as a result of the individual forms being juxtaposed and then some or all of the aforesaid forms can be removed and replaced by different forms and/or some or all of the forms can be removed and replaced by the same forms in different juxtaposition. Two sets of eight movable playing units are contained on and move on the playing surface of square and rectangular forms, wherein the movable units engage and capture each other. All eight units on one end of the game board are WHITE in color and all eight units on the opposite end of the game board are BLACK in color; all 16 movable units are known as ground units. A ground unit that succeeds in crossing from one end of the game board to the opposite end becomes an airborne unit and, as a result, increases its movement potential. However, there are games concluded without the use of airborne units. Still other games are concluded with only one playing side having the use of one airborne unit. If players are evenly matched, both may have available to them at least one airborne unit. No more than three airborne units can be designated by each playing side during the course of the game.

BRIEF DESCRIPTION OF THE DRAWINGS

The objects and features of the invention may be understood with reference to the following detailed description of an illustrative embodiment of the invention, taken together with the accompanying drawings in which:

FIG. 1 illustrates a top plan view of the game board that is used as a support base upon which other parts of the game are placed;

FIG. 2 illustrates one fourth of the total game board playing surface or one half of the game board playing surface that exists on one of the two playing sides;

FIG. 3 illustrates side view of an upraised strip;

FIG. 4 illustrates upraised strips that hold small square form in place;

FIG. 5 illustrates upraised strips that hold large square form in place;

FIG. 6 illustrates top planar view of small square form that has WHITE center;

FIG. 7 illustrates top planar view of large square form that has WHITE center;

FIG. 8 illustrates top planar view of small square form that has BLACK center;

FIG. 9 illustrates top planar view of large square form that has BLACK center;

FIG. 10 illustrates upraised strips that hold small rectangle form in place in a horizontal attitude;

FIG. 11 illustrates upraised strips that hold small rectangle form in place in a vertical attitude;

FIG. 12 illustrates top planar view of small rectangle form that has WHITE center and is placed in horizontal attitude;

FIG. 13 illustrates top planar view of small rectangle form that has WHITE center and is placed in vertical attitude;

FIG. 14 illustrates top planar view of small rectangle form that has BLACK center and is placed in horizontal attitude;

FIG. 15 illustrates top planar view of small rectangle form that has BLACK center and is placed in vertical attitude;

FIG. 16 illustrates upraised strips that hold large rectangle form in place in a horizontal attitude;

FIG. 17 illustrates upraised strips that hold large rectangle form in place in a vertical attitude;

FIG. 18 illustrates top planar view of large rectangle form that has WHITE center and is placed in horizontal attitude;

FIG. 19 illustrates top planar view of large rectangle form that has WHITE center and is placed in vertical attitude;

FIG. 20 illustrates top planar view of large rectangle form that has BLACK center and is placed in horizontal attitude;

FIG. 21 illustrates top planar view of large rectangle form that has BLACK center and is placed in vertical attitude;

FIG. 22 illustrates side view of small square form;

FIG. 23 illustrates side view of large square form;

FIG. 24 illustrates side view of long side of small rectangle form;

FIG. 25 illustrates side view of short side of small rectangle form;

FIG. 26 illustrates side view of long side of large rectangle form;

FIG. 27 illustrates side view of short side of large rectangle form;

FIG. 44 illustrates how a written record of game moves appears based upon regular pattern illustrated in FIG. 43.

DESCRIPTION OF THE PREFERRED EMBODIMENT

Figure 28:
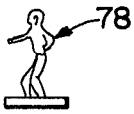
FIG. 28 illustrates front view of a movable ground unit marker.
Figure 29:
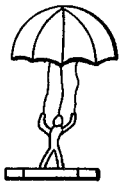
FIG. 29 illustrates front view of a movable airborne unit marker.

Turning now descriptively to the drawings, in which similar reference characters denote similar elements throughout the several views, FIG. 1 shows a game board 10 used for a game of airborne. A latticework 12 of identical-sized boxes 14 are contained on the upper surface 16 of the board 10, wherein the latticework 12 consists of eight rows 18, 20, 22, 24, 26, 28, 30, 32 and eight columns 34, 36, 38, 40, 42, 44, 46, 48 intersecting each other. The game board 10 is shown as being made up of four equal-sized sections 50, 52, 54, 56 constructed with center latitudinal space 58 separating WHITE playing side 21 from BLACK playing side 23, center longitudinal space 60, separating WHITE playing side into left and right sections, and center longitudinal space 60, separating BLACK playing side into left and right sections; all this intended to allow the entire game board to be folded into four parts for easier handling and storage. Each of the equal-sized sections 50, 52, 54, 56 contains a latticework of 16 equal-sized boxes or guide-line squares 62. At each end of the latticework 12, are starting rows 64, 66 of eight boxes 68 each. Each box 68 is called a starting position and is numbered to indicate where the movable markers with corresponding numbers should be placed at the start of the game. Forward lines 70 are indicated as W4, W3, W2, W1 and 0 (zero) for the WHITE playing side of the game board and forward lines 70 are indicated as B4, B3, B2, B1 and 0 (zero) for the BLACK playing side of the game board. The said forward lines help to determine whether or not moves are indeed moves in a forward direction. Note that forward direction for the WHITE movable markers (from WHITE end of the game board toward BLACK end of the game board) is opposite to the forward direction for the BLACK movable markers (from BLACK end of the game board toward WHITE end of the game board). Therefore, in some situations during the playing of the game a forward move by a given WHITE movable marker is a sideways move for a BLACK movable marker into adjacent position, or vice versa. Individual square and rectangle forms are positions. Sideways moves are, of course, not allowed so that in some situations either a given WHITE movable marker threatens to capture a given BLACK movable marker or even threatens to capture one of two given BLACK movable markers when WHITE movable marker moves in its next turn. WHITE movable marker would, of course, be moving in a forward direction in order to capture. BLACK marker or markers threatened with being captured would not have the option of capturing because movement by a given BLACK movable marker is such a situation would be sideways, not forward, owing to the fact that forward directions for WHITE and BLACK movable markers are opposite to each other and the particular pattern used dictates possible options of forward movement. Therefore, WHITE movable marker would threaten BLACK movable marker but BLACK movable marker would not threaten WHITE movable marker. The same would be true in those situations where BLACK would threaten WHITE but WHITE would not threaten BLACK, depending upon the pattern and guided by the forward lines to determine which moves are forward moves and which are sideways moves, for WHITE movable markers in one direction and for BLACK movable markers in direction opposite to WHITE, the opposing movable markers moving toward each other for confrontation.

FIG. 1 illustrates the game board 10 as it appears before a particular pattern is created with most of the 24 square and rectangle forms provided to WHITE and with most of the 24 square and rectangle forms provided to BLACK.

Figure 43:
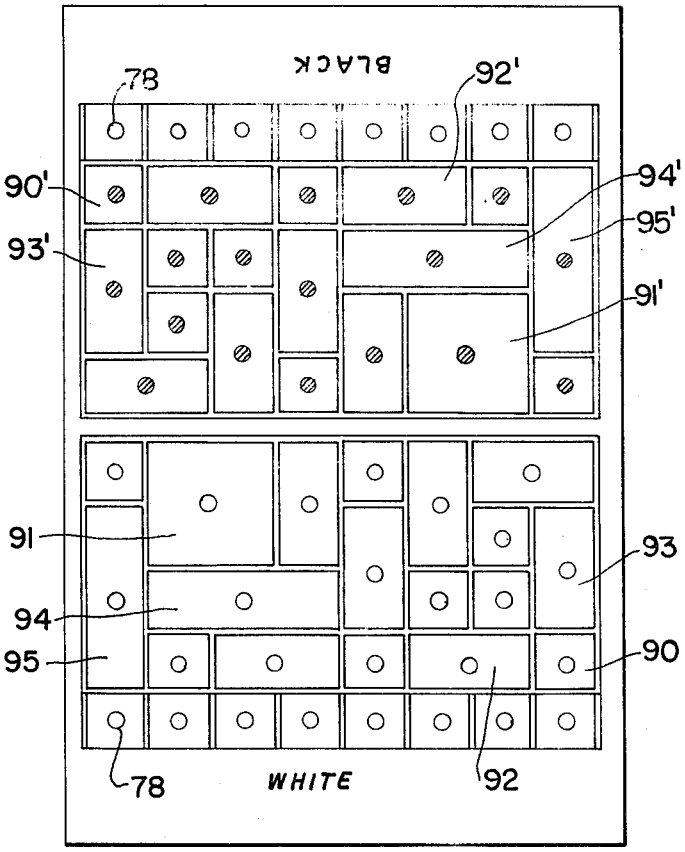
FIG. 43 illustrates what a regular pattern might look like after identical forms have been placed in identical locations on respective WHITE and BLACK playing sides of the game board.

FIG. 43 illustrates a regular pattern (where WHITE and BLACK playing sides are identical) and a maximum of 20 positions are used per playing side. Either 12, 13, 14, 15, 16, 17, 18, 19 or 20 positions is the possible total per playing side, according to pattern. Moves made during game will determine the winning playing side.

An irregular pattern (where WHITE and BLACK playing sides are not identical) may also be created, but after each game is concluded, players change playing sides before the start of the next game, to assure equal movement opportunities. The winning playing side will now be determined by the moves made during the game as well as the possible different effect of the WHITE as opposed to the BLACK pattern on those moves. In addition, both playing sides might have the same number of each type of form and still have different patterns because of different placement of said forms.

Figure 30:
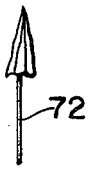
FIG. 30 illustrates a side view of a folded parachute.
Figure 31:
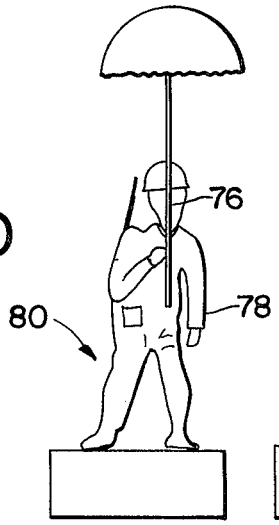
FIG. 31 illustrates front view of airborne unit marker showing possible actual size and how after parachute is opened, it is inserted into small aperture that runs down from top of head through head, neck and chest of soldier-image to mid-waist.
Figure 32:
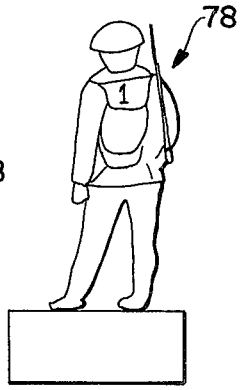
FIG. 32 illustrates rear view of ground unit marker that does not have parachute inserted therein and has a number 1 that is used for identification, each set of eight movable markers being numbered consecutively 1 through 8.
Figure 33:
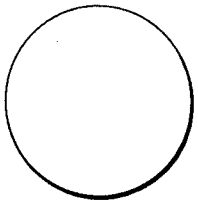
FIG. 33 illustrates top planar view of movable unit marker base support which is also the same size as bottom circumference of parachute when opened.
Figure 34:
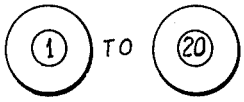
FIG. 34 illustrates one of two sets of circular discs that are used when a written record of game moves is desired. Discs are transparent except for small round centers that are opaque and are numbered consecutively 1 througn 20. Each disc is placed in center of square or rectangle form that it describes until all forms on each playing side have been numbered.
Figure 35:
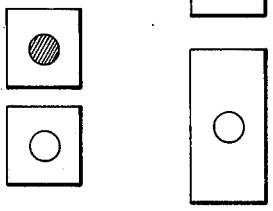
FIG. 35 illustrates two small squares where either WHITE or BLACK ground unit marker has only one option of forward movement.
Figure 36:
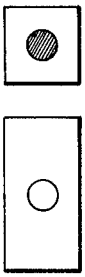
FIG. 36 illustrates a small square and small vertical rectangle where either WHITE or BLACK ground unit marker has only one option of forward movement.
Figure 37:
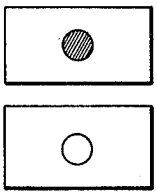
FIG. 37 illustrates two small horizontal rectangles where either WHITE or BLACK ground unit marker has only one option of forward movement.
Figure 38:
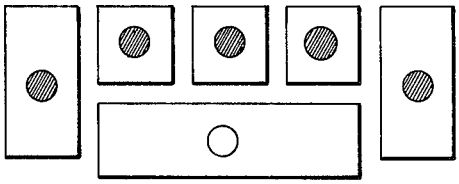
FIG. 38 illustrates maximum number of options of forward movement in direction shown (five options of forward movement from large horizontal rectangle)
Figure 39:
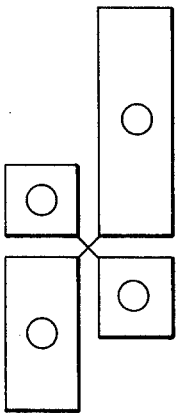
FIG. 39 illustrates four adjacent forms meeting at a common point, called an intersecting point. Diagonal moves across this point and others like it are prohibited except when an airborne unit marker executes "jump" from one type of form to identical type of form. Movement "on the ground" across intersecting points is prohibited.
Figure 40:
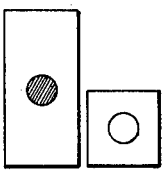
FIG. 40 illustrates WHITE ground unit marker in occupation of a small square with forward direction access to small vertical rectangle where BLACK ground unit marker can be captured; opposite forward direction for BLACK ground unit marker is such that in relation to the forms shown, BLACK ground unit marker cannot move from small vertical rectangle into small square because both those forms have same BLACK forward line, wherein no sideways move is allowed, therefore, WHITE threatens BLACK with capture but BLACK does not threaten WHITE with capture.
Figure 41:
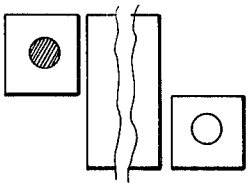
FIG. 41 illustrates WHITE and BLACK ground unit markers in occupation of small squares, where either ground unit can enter small vertical rectangle located between two small squares.
Figure 42:
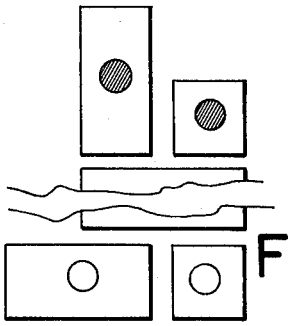
FIG. 42 illustrates a confrontation where an equal number of WHITE and BLACK ground units face each other in a confrontation.

Umbrella-shaped or parachute pieces 72 in closed position, as shown in FIG. 30, are taken out of recessed storage pockets 74 on the game board 10, the recessed storage pockets 74 being configurated to support the umbrella-shaped pieces 72 in closed position. When a WHITE or BLACK movable marker or ground unit 78, as shown in FIG. 28 succeeds in crossing from one end of the game board to the opposite end in either forward direction, an umbrella-shaped piece 72 is removed from recessed storage pocket 74 and the umbrella-shaped piece 72 is opened up and the stem of the umbrella-shaped piece is inserted into a small aperture 76 running from the top of the soldier-figure movable piece 78 (ground unit) in FIG. 31 to its mid-waist. The umbrella-shaped piece 72 in its open position, placed upon soldier-figure movable unit 78 resembles a parachute and converts soldier-figure 78 (without parachute) of FIG. 32 into an airborne unit 80 having a paratrooper-likeness.

Numbers 1, 2, 3, 4, 5, 6, 7, 8, 9 shown on WHITE playing side 21 are used to keep track of the number of WHITE moves. Numbers 10, 20, 30, 40, 50 shown on the WHITE playing side are used to keep track of the number of WHITE moves. Similarly, non-illustrated numbers 1, 2, 3, 4, 5, 6, 7, 8, 9 on BLACK playing side 23 are used to keep track of the number of BLACK moves. Also, non-illustrated numbers 10, 20, 30, 40, 50 on BLACK playing side 23 are used to keep track of the number of BLACK moves. Taken together, the ones and tens columns numbers on the game board 10 are covered by two coins; one coin records the moves in the ones column and when the number 9 is reached, the other coin in the tens column is moved up to the next higher tens number. Each game should be completed after WHITE and BLACK playing sides have made between 25 to 35 moves each and within 30 minutes to 1 hour. Numbers +1, +2, +3, +4, +5, +6, +7, +8, +9, +10, +11, +12 on WHITE playing side 21 are covered with still another coin to keep track of points won when a series of games is played for points value. Similarly, non-illustrated numbers +1, +2, +3, +4, +5, +6, +7, +8, +9, +10, +11, +12 on the BLACK playing side 23 are covered with still another coin to keep track of points won when a series of games is played for points value. Draw games are those games that result in each playing side having one airborne unit remaining on the game board and neither unit can capture the other. Such a draw game means no points earned. Draw with advantage in numbers games are those games that result in one playing side having two airborne units remaining on the game board, and the opposing playing side having only one airborne unit remaining on the game board but the more numerous units cannot eliminate the single unit. Such a draw with advantage in numbers game means one point earned for the more numerous playing side. Games that are won after the 30th move in which one playing side loses all its movable units means two points earned for the playing side that eliminates all the opposing movable units. Games that are won before 30th move in which one playing side loses all its movable units means three points earned for the playing side that eliminates all the opposing movable units. Games concluded before 30th move do not usually use airborne units; the ground units succeed in blocking and then eliminating each other until one playing side runs out of safe moves and must continue to move into those positions on the playing board where the opposing side captures each ground unit that has just moved until all are eliminated. A series of games is won when one playing side has accumulated either six points (short series) or 12 points (regular series). A series of games can also be played based upon which player is the first to win three games (short series) or six games (regular series) regardless of the number of moves required to win and not counting draws of any kind. It is important to note that when all movable units of one playing side are not eliminated and a draw is eventually declared the rule to follow is that players must make certain that any airborne unit is not permitted to make more than two consecutive "jump" moves without capturing an opposing movable unit. After the second consecutive "jump" move without capture of an opposing movable unit (ground or airborne) if one or more ground units of the same color as the airborne unit that has made two such consecutive moves exist on the game board, a ground unit must be moved forward even if it means being captured. This rule prevents repetitive moves of airborne unit(s) and requires continued forward movement of ground units until all ground units are eliminated before a draw can be declared after only airborne units remain on the game board.

The movable units move across a pattern such as that created in FIG. 43. This pattern is the result of the placement of square and rectangle forms, fitted into the latticework 12 of upraised strips to hold them in position. The movable units 78 shown in FIG. 28 are arranged on starting rows 64,66 just before they begin to move. These units 78 are called ground units. If a ground unit reaches the opposite end of the playing surface, the ground unit becomes or is designated an airborne unit 80 by placing an umbrella-shaped piece 72 that can be opened (like an umbrella) to resemble a parachute when placed into the small aperture 76 running from the top of the head through the mid-waist of the soldier-figure 78. The ground units must always move in a forward direction as determined by the respective forward lines 70. A move from a form occupied is forward when the new form occupied has a more forward line than the one just occupied. If the same forward line is shared by the old position vacated and the new position occupied by the ground unit, then the move is not forward but sideways. As an alternate rule, players may decide to allow moves between forms that share the same forward line as long as the center of the new form occupied by a ground unit is more forward than the center of the form that has been vacated. Such an alternate rule creates some additional permitted forward moves but does not change the game all that much. Rearward moves are obvious and are never permitted because such moves would detract from the game. Moves across points where four forms intersect or meet is not allowed because such moves allow ground units to disregard the pattern itself which dictates movement based upon juxtaposition of the individual squares and rectangles within it. Even so, a ground unit may have up to five options of forward movement but in more situations there are either one, two or, perhaps three options of forward movement. Those positions that allow three or more options of forward movement are called superior positions. Those positions that allow two options of forward movement are still preferable to those positions that allow only one possible option of forward movement. A movable ground unit can block one or more ground units of the same color behind it because only one unit can occupy each position. Attempt should be made to retain flexible movement potential to keep a "closed defensive line", and "control of the center".

A ground unit protects each position that it has option to move into on the next move. A ground unit captures an opposing unit (ground or airborne) by moving from one subdivision (square or rectangle form) in a forward direction into another subdivision occupied by the opposing unit. Opposing unit is then removed from the game board. Captures may or may not be made. Confrontations between opposing ground units lead to capture exchanges between them. When equal numbers of opposing ground units are separated by a vacant position between them a confrontation is said to exist. The playing side that moves one of its ground units into that vacant position first will suffer the loss of all of its ground units that become part of the capture exchange action but the opposing playing side will have one ground unit that remains on the game board after that ground unit completes a capture which is last capture of that capture exchange. Therefore, whenever possible, it is best to avoid making a move into a vacant position first to avoid losing one more ground unit than opposing playing side loses after capture exchange is completed.

Furthermore, it is important to understand that there are confrontations where a given ground unit marker of one playing side threatens either one or two opposing ground unit markers with capture and where opposing ground unit marker(s) cannot capture because forward directions of opposing playing sides are opposite to one another. Therefore, a forward move by a ground unit marker of one side into a given position occupied by an opposing ground unit marker to capture that ground unit marker is a sideways move for opposing ground unit marker when it is moved into same position because opposing ground unit marker moves in opposite forward direction. This means one playing side exerts pressure and opposing playing side should move its exposed ground unit to a safe position or allow a capture. In cases where two ground units are threatened simultaneously, only one can be saved.

Once a ground unit reaches a subdivision or position (all these terms are synonymous) that touches the opposite end of the game board it is designated airborne. An airborne unit moves by "jumping" between identical types of forms that fall into six categories; small squares 90 or 90', large squares 91 or 91', small rectangles placed in horizontal attitude 92 or 92', small rectangles placed in vertical attitude 93 or 93', large rectangles placed in horizontal attitude 94 or 94', and large rectangles placed in vertical attitude 95 or 95'. A "jump" move from one position to an identical type of position is the only move that may cross an intersecting point if the identical forms happen to be adjacent. "Jumps" between two such different forms as a small rectangle in horizontal attitude and small rectangle in verticle attitude are not allowed. The same goes for horizontal and vertical large rectangles. An opposing unit occupying a subdivision identical to the one occupied must be captured by the airborne unit in its turn or the opposing playing side has the right to remove the airborne unit (failing to capture) from play. Captures by airborne units take precedence over captures to be made by ground unit(s). To repeat, no more than two consecutive "jump" moves are allowed without an opposing marker being captured. After second consecutive "jump" a ground unit marker of same color must be moved, even if it means being captured.

An airborne unit can move into a subdivision different than the subdivision it occupies if the different subdivision is adjacent to the subdivision occupied by airborne unit and a capture is to be made. As long as an intersecting point is not crossed, the airborne unit is allowed to move forward, sideways or rearward. Whether capture is made by "jumping" to an identical form anywhere else on the game board or by moving to an adjacent different form ("moving on the ground") both types of captures are equally valid and captures of either type must be made; otherwise an airborne unit that fails to make capture is removed from the game board.

If a given ground unit becomes airborne on a large vertical rectangle and there are no other large vertical rectangles anywhere else on the game board pattern, then the newly-designated airborne unit must remain on that position unless an opportunity to capture on the ground presents itself and thus, the airborne unit can move to another type of form that is adjacent in order to capture an opposing movable marker. In other words, designating a ground unit marker airborne on a type of form that is the only such type of form on the pattern prohibits "jumps".

The play alternates back and forth between the two, three or four players (two playing sides) until each game is concluded. One player may face one opposing player. One player may face two opposing players. Two players may face two opposing players. In addition, one player may play the game against himself (herself). In the case of a team (two players on a playing side) each one of the two players on a team takes turns at movement. There is no coaching allowed between respective players on a team. The player on a team that makes the last capture of a game is the winning player. Any points to be earned (if point system is used) go to player that makes the last capture of a game.

Players or teams should alternate playing WHITE. The same pattern should be used for two games in order to allow each player to play WHITE and BLACK once. After the second game is completed, the pattern can be changed in preparation for the next two games.

The team playing side is used to refer to one player playing either WHITE or BLACK, or, to refer to two players on a team playing either WHITE or BLACK.

The following procedure is used when a written record of game moves is desired:

Two sets of transparent discs with opaque centers are used to number positions within WHITE and BLACK playing sides of the game board. Each set of discs is numbered 1 through 20. As few as 12 up to as many as 20 discs are used to number forms on each playing side. Seated behind WHITE playing side of the game board, WHITE positions are numbered from left to right, starting with those forms that have W3 as their forward line, next, those forms that have W2 as their forward line, next, those forms that have W1 as their forward line, and finally, those forms that have 0 (zero) as their forward line. The 0 (zero) line is where WHITE and BLACK forms meet. Forward direction of movement for WHITE ground unit markers means crossing W4 forward line first when WHITE ground units leave their starting positions and one or more may continue to move forward through W3, W2, W1, 0, B1, B2, and B3 forward lines until one or more positions that have B4 as the forward line (from perspective of where WHITE player(s) are seated) are occupied which means the game board has been crossed and the ground unit(s) become airborne unit(s). Forward direction of movement for BLACK ground unit markers means crossing B4 forward line first when BLACK ground units leave starting positions and one or more may continue to move forward through B3, B2, B1, 0, W1, W2 and W3 forward lines until one or more positions that have W4 as the forward line (from perspective of where BLACK players(s) are seated) are occupied which means that game board has been crossed and the ground unit(s) become airborne unit(s).

Obviously, various modifications of the rules of movements of the units 78,80, the size of the playing surface, the designs of the various playing patterns or even the number of units 78,80 can be made, but these changes are considered to be within the spirit and scope of the invention described herein. The limitations as set forth in this description are for purely illustrative purposes and are not to be considered as limiting in scope.

Having thus described the invention, what I claim as new and desire to secure by Letters Patent of the United States is:

1. A board game of battleground situations, comprising in combination:

a. a foundation board having an elongated upper surface, a longitudinal axis extending in direction of the elongation of said upper surface, a transverse axis extending in direction transversely of said longitudinal axis, and a plurality of board parts connected together for folding about said axes;

b. a latticework on said board and including a plurality of raised portions extending away from said upper surface, said raised portions bounding a plurality of substantially identically-sized boxes;

c. means for producing a playing board of random pattern on said foundation board, including a plurality of forms each engageable with said latticework to produce a plurality of possible patterns for said playing board, and each form having a central portion identified by one of two colors for distinguishing said forms into two sets, each set including small squares each small square having a predetermined size adapted to be received within a respective box of said latticework, large squares, small rectangles, and large rectangles, each large square, small rectangle and large rectangle all being of size greater than said predetermined size of a respective small square, and all having grooves for receiving selected ones of said raised portions;

d. two color-differentiated sets of soldier-type playing pieces each having an aperture and being movable from one end of said upper surface of said foundation board over said playing board towards the opposite end of said upper surface in accordance with a predetermined movement characteristic; and e. means for converting a respective soldier-type playing piece into an airborne-type playing piece having a different movement characteristic, including a plurality of parachute-type pieces each having an umbrella-shaped portion and a stem insertable into the aperture of a respective soldier-type playing piece when the latter has moved from said one end of said opposite end of said upper surface of said foundation board.

2. The board game of claim 1, wherein each set of forms includes ten of said small squares, three of said large squares, three of said large rectangles, and eight of said small rectangles.

3. The board game of claim 1, wherein each set of said soldier-type playing pieces includes eight of the latter.

4. The board game of claim 1, wherein the central portions of one of said sets of forms are colored white, and the central portions of the other of said sets of forms are colored black.

* * * * *